US006081252A

United States Patent [19]

Reddy

[11] Patent Number: 6,081,252

[45] **Date of Patent: *Jun. 27, 2000**

[54] DISPERSION-BASED TECHNIQUE FOR PERFORMING SPACIAL DITHERING FOR A DIGITAL DISPLAY SYSTEM

[75] Inventor: Dayakar Chandram Reddy, San Jose, Calif.

[73] Assignee: National Semiconductor Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,469

[22] Filed: Jul. 11, 1997

[51] Int. Cl.[7] ..... G09G 5/10

[52] U.S. Cl. ..... 345/153; 345/149; 345/155; 358/457

[58] Field of Search ..... 345/149, 152, 345/153, 155; 358/457

[56] References Cited

U.S. PATENT DOCUMENTS

| | | | |
|---|---|---|---|
| 4,709,995 | 12/1987 | Kuribayashi et al. | 350/350 S |
| 4,747,671 | 5/1988 | Takahashi et al. | 350/336 |
| 5,185,602 | 2/1993 | Bassetti, Jr. et al. | 340/793 |
| 5,293,159 | 3/1994 | Bassetti, Jr. et al. | 345/149 |
| 5,298,915 | 3/1994 | Bassetti, Jr. | 345/149 |
| 5,404,427 | 4/1995 | Cawley et al. | 345/153 |
| 5,455,600 | 10/1995 | Friedman et al. | 345/153 |
| 5,469,190 | 11/1995 | Masterson | 345/155 |
| 5,479,188 | 12/1995 | Moriyama | 345/149 |
| 5,495,346 | 2/1996 | Choi et al. | 358/457 |
| 5,508,822 | 4/1996 | Ulichney et al. | 358/457 |
| 5,553,200 | 9/1996 | Accad | 395/109 |
| 5,586,203 | 12/1996 | Spaulding et al. | 382/270 |
| 5,619,230 | 4/1997 | Edgar | 345/150 |
| 5,621,825 | 4/1997 | Masaki et al. | 382/274 |
| 5,673,065 | 9/1997 | DeLeeuw | 345/152 |
| 5,818,419 | 10/1998 | Tajima et al. | 345/147 |
| 5,896,122 | 4/1999 | MacDonald et al. | 345/153 |

FOREIGN PATENT DOCUMENTS 0 654 777 A1 5/1995 European Pat. Off. ..... G09G 3/34

*Primary Examiner*—Bipin Shalwala
*Assistant Examiner*—Vincent E. Kovalick
*Attorney, Agent, or Firm*—Limbach & Limbach L.L.P.

[57] ABSTRACT

A technique for performing spacial dithering for a digital display system. A display panel is portioned into eight-by-eight arrays of 64 pixels, each pixel including three primary color sub-pixels. A predetermined number of bits represent a color level for each sub-pixel according to image data. If the display system can accept only fewer bits than the predetermined number, bits must be discarded. The discarded bits are used to modify the remaining bits before the remaining bits are passed to the display system. A memory stores 64 tables, each table including an entry for each pixel within an eight-by-eight array. The entry for a pixel determines whether or not the color level for the corresponding sub-pixel is to be decremented by one. A first of the sixty-four tables does not result in decrementing any color levels. Each successive table decrements the color level for one more pixel than the previous table. The values of discarded bits select among the stored tables. whereas, the values of bits that are retained are selectively decremented according to entries in the selected table. Entries in the tables are dispersed so as to avoid decrementing color levels in a pattern that would otherwise tend to result in image artifacts. This is accomplished by avoiding vertical, horizontal or diagonal lines, and checker-board patterns of pixels for which the color level is decremented. As a result, artifacts induced by the dithering process are reduced in comparison to prior dithering techniques.

24 Claims, 15 Drawing Sheets pix_cnt

| lin_cnt | 0 | 1 | 2 | 3 | 4 | 5 | 6 | 7 |
|---|---|---|---|---|---|---|---|---|
| 0 | 0 | 0 | 0 | 0 | 0 | 0 | 0 | 0 |
| 1 | 0 | 0 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

FIG. 4 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 0 | 0 | 0 | 0 |
| 1 | 0 | 0 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

FIG. 5 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 0 | 0 | 0 | 0 |
| 1 | 0 | 0 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 1 | 0 | 0 | 0 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

FIG. 6 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 0 | 0 | 0 | 0 |
| 1 | 0 | 0 | 0 | 0 | 0 | 0 | 0 | 0 |
| 2 | 0 | 0 | 0 | 0 | 0 | 1 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 0 | 0 | 0 | 0 | 0 | 0 | 0 | 0 |
| 6 | 0 | 0 | 0 | 1 | 0 | 0 | 0 | 0 |
| 7 | 0 | 0 | 0 | 0 | 0 | 0 | 0 | 0 |

FIG. 7 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

FIG. 8 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 0 | 0 | 0 | 1 | 0 | 0 | 0 | 0 |
| 3 | 0 | 0 | 0 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |

FIG. 9 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 0 | 0 | 0 | 1 | 0 | 0 | 0 | 0 |
| 3 | 0 | 0 | 0 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 0 | 0 |
| 6 | 0 | 0 | 0 | 1 | 0 | 0 | 0 | 0 |
| 7 | 0 | 0 | 0 | 0 | 0 | 0 | 0 | 0 |

FIG. 10 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 0 | 0 | 1 | 0 | 0 | 1 | 0 | 0 |
| 3 | 0 | 0 | 0 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 0 | 0 |
| 6 | 0 | 0 | 1 | 0 | 0 | 0 | 0 | 0 |
| 7 | 0 | 0 | 0 | 0 | 0 | 0 | 0 | 0 |

FIG. 11 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 1 | 0 | 0 | 0 | 1 | 0 | 0 | 0 |
| 3 | 0 | 0 | 0 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 0 | 0 |
| 6 | 1 | 0 | 0 | 0 | 1 | 0 | 0 | 0 |
| 7 | 0 | 0 | 0 | 0 | 0 | 0 | 0 | 0 |

FIG. 12 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 1 | 0 | 0 | 0 | 1 | 0 | 0 | 0 |
| 3 | 0 | 0 | 1 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 0 | 0 |
| 6 | 1 | 0 | 0 | 0 | 1 | 0 | 0 | 0 |
| 7 | 0 | 0 | 0 | 0 | 0 | 0 | 0 | 0 |

FIG. 13 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 1 | 0 | 0 | 0 | 1 | 0 | 0 | 0 |
| 3 | 0 | 0 | 1 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 1 | 0 |
| 6 | 1 | 0 | 0 | 0 | 1 | 0 | 0 | 0 |
| 7 | 0 | 0 | 0 | 0 | 0 | 0 | 0 | 0 |

FIG. 14 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 1 | 0 | 0 | 0 | 1 | 0 | 0 | 0 |
| 3 | 0 | 0 | 1 | 0 | 0 | 0 | 0 | 0 |
| 4 | 1 | 0 | 0 | 0 | 1 | 0 | 0 | 0 |
| 5 | 0 | 0 | 0 | 0 | 0 | 0 | 0 | 0 |
| 6 | 1 | 0 | 0 | 0 | 1 | 0 | 0 | 0 |
| 7 | 0 | 0 | 1 | 0 | 0 | 0 | 1 | 0 |

FIG. 15 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 0 | 0 | 0 | 0 | 0 | 0 |
| 2 | 1 | 0 | 0 | 0 | 1 | 0 | 0 | 0 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 0 | 0 | 0 | 0 | 0 | 0 |
| 6 | 1 | 0 | 0 | 0 | 1 | 0 | 0 | 0 |
| 7 | 0 | 0 | 1 | 0 | 0 | 0 | 1 | 0 |

FIG. 16 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 0 | 0 |
| 2 | 1 | 0 | 0 | 0 | 1 | 0 | 0 | 0 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 0 | 0 | 0 | 0 | 0 | 0 |
| 6 | 1 | 0 | 0 | 0 | 1 | 0 | 0 | 0 |
| 7 | 0 | 0 | 1 | 0 | 0 | 0 | 1 | 0 |

FIG. 17 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 1 | 0 |
| 2 | 1 | 0 | 0 | 0 | 1 | 0 | 0 | 0 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 0 | 0 | 0 | 0 | 0 | 0 |
| 6 | 1 | 0 | 0 | 0 | 1 | 0 | 0 | 0 |
| 7 | 0 | 0 | 1 | 0 | 0 | 0 | 1 | 0 |

FIG. 18 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 1 | 0 |
| 2 | 1 | 0 | 0 | 0 | 1 | 0 | 0 | 0 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 0 | 0 | 0 | 0 | 1 | 0 |
| 6 | 1 | 0 | 0 | 0 | 1 | 0 | 0 | 0 |
| 7 | 0 | 0 | 1 | 0 | 0 | 0 | 1 | 0 |

FIG. 19 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 1 | 0 |
| 2 | 1 | 0 | 0 | 0 | 1 | 0 | 0 | 0 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 1 | 0 | 0 | 0 | 1 | 0 |
| 6 | 1 | 0 | 0 | 0 | 1 | 0 | 0 | 0 |
| 7 | 0 | 0 | 1 | 0 | 0 | 0 | 1 | 0 |

FIG. 20 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 1 | 0 |
| 2 | 1 | 0 | 0 | 1 | 1 | 0 | 0 | 0 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 1 | 0 | 0 | 0 | 1 | 0 |
| 6 | 1 | 0 | 0 | 0 | 1 | 0 | 0 | 0 |
| 7 | 0 | 0 | 1 | 0 | 0 | 0 | 1 | 0 |

FIG. 21 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 1 | 0 |
| 2 | 1 | 0 | 0 | 1 | 1 | 0 | 0 | 0 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 1 | 0 | 0 | 0 | 1 | 0 |
| 6 | 1 | 0 | 0 | 0 | 1 | 0 | 0 | 1 |
| 7 | 0 | 0 | 1 | 0 | 0 | 0 | 1 | 0 |

FIG. 22 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 1 | 0 |
| 2 | 1 | 0 | 0 | 1 | 1 | 0 | 0 | 1 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 1 | 0 | 0 | 0 | 1 | 0 |
| 6 | 1 | 0 | 0 | 0 | 1 | 0 | 0 | 1 |
| 7 | 0 | 0 | 1 | 0 | 0 | 0 | 1 | 0 |

FIG. 23 pix_cnt

| lin_cnt | 0 | 1 | 2 | 3 | 4 | 5 | 6 | 7 |
|---|---|---|---|---|---|---|---|---|
| 0 | 1 | 0 | 0 | 0 | 1 | 0 | 0 | 0 |
| 1 | 0 | 0 | 1 | 0 | 0 | 0 | 1 | 0 |
| 2 | 1 | 0 | 0 | 1 | 1 | 0 | 0 | 1 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 1 | 0 | 0 | 0 | 1 | 0 |
| 6 | 1 | 0 | 0 | 1 | 1 | 0 | 0 | 1 |
| 7 | 0 | 0 | 1 | 0 | 0 | 0 | 1 | 0 |

FIG. 24 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 0 | 0 |
| 1 | 0 | 0 | 1 | 0 | 0 | 0 | 1 | 0 |
| 2 | 1 | 0 | 0 | 1 | 1 | 0 | 0 | 1 |
| 3 | 0 | 0 | 1 | 0 | 0 | 0 | 1 | 0 |
| 4 | 1 | 0 | 0 | 0 | 1 | 0 | 0 | 0 |
| 5 | 0 | 0 | 1 | 0 | 0 | 0 | 1 | 0 |
| 6 | 1 | 0 | 0 | 1 | 1 | 0 | 0 | 1 |
| 7 | 0 | 0 | 1 | 0 | 0 | 0 | 1 | 0 |

FIG. 25 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 0 | 0 |
| 1 | 0 | 0 | 1 | 0 | 0 | 0 | 1 | 0 |
| 2 | 1 | 0 | 0 | 1 | 1 | 0 | 0 | 1 |
| 3 | 0 | 0 | 1 | 0 | 0 | 0 | 1 | 0 |
| 4 | 1 | 0 | 0 | 0 | 1 | 0 | 1 | 0 |
| 5 | 0 | 0 | 1 | 0 | 0 | 0 | 1 | 0 |
| 6 | 1 | 0 | 0 | 1 | 1 | 0 | 0 | 1 |
| 7 | 0 | 0 | 1 | 0 | 0 | 0 | 1 | 0 |

FIG. 26 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 0 | 0 |
| 1 | 0 | 0 | 1 | 0 | 0 | 0 | 1 | 0 |
| 2 | 1 | 0 | 0 | 1 | 1 | 0 | 0 | 1 |
| 3 | 0 | 0 | 1 | 0 | 0 | 0 | 1 | 0 |
| 4 | 1 | 0 | 1 | 0 | 1 | 0 | 1 | 0 |
| 5 | 0 | 0 | 1 | 0 | 0 | 0 | 1 | 0 |
| 6 | 1 | 0 | 0 | 1 | 1 | 0 | 0 | 1 |
| 7 | 0 | 0 | 1 | 0 | 0 | 0 | 1 | 0 |

FIG. 27 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 0 | 1 | 0 | 0 | 0 | 1 | 0 |
| 2 | 1 | 0 | 0 | 1 | 1 | 0 | 0 | 1 |
| 3 | 0 | 0 | 1 | 0 | 0 | 0 | 1 | 0 |
| 4 | 1 | 0 | 1 | 0 | 1 | 0 | 1 | 0 |
| 5 | 0 | 0 | 1 | 0 | 0 | 0 | 1 | 0 |
| 6 | 1 | 0 | 0 | 1 | 1 | 0 | 0 | 1 |
| 7 | 0 | 0 | 1 | 0 | 0 | 0 | 1 | 0 |

FIG. 28 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 0 | 1 | 0 | 0 | 0 | 1 | 0 |
| 2 | 1 | 0 | 0 | 1 | 1 | 0 | 0 | 1 |
| 3 | 1 | 0 | 1 | 0 | 0 | 0 | 1 | 0 |
| 4 | 1 | 0 | 1 | 0 | 1 | 0 | 1 | 0 |
| 5 | 0 | 0 | 1 | 0 | 0 | 0 | 1 | 0 |
| 6 | 1 | 0 | 0 | 1 | 1 | 0 | 0 | 1 |
| 7 | 0 | 0 | 1 | 0 | 0 | 0 | 1 | 0 |

FIG. 29 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 0 | 1 | 0 | 0 | 0 | 1 | 0 |
| 2 | 1 | 0 | 0 | 1 | 1 | 0 | 0 | 1 |
| 3 | 1 | 0 | 1 | 0 | 0 | 0 | 1 | 0 |
| 4 | 1 | 0 | 1 | 0 | 1 | 0 | 1 | 0 |
| 5 | 0 | 0 | 1 | 0 | 0 | 0 | 1 | 0 |
| 6 | 1 | 0 | 0 | 1 | 1 | 0 | 0 | 1 |
| 7 | 1 | 0 | 1 | 0 | 0 | 0 | 1 | 0 |

FIG. 30 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 0 | 1 | 0 | 0 | 0 | 1 | 0 |
| 2 | 1 | 0 | 0 | 1 | 1 | 0 | 0 | 1 |
| 3 | 1 | 0 | 1 | 0 | 1 | 0 | 1 | 0 |
| 4 | 1 | 0 | 1 | 0 | 1 | 0 | 1 | 0 |
| 5 | 0 | 0 | 1 | 0 | 0 | 0 | 1 | 0 |
| 6 | 1 | 0 | 0 | 1 | 1 | 0 | 0 | 1 |
| 7 | 1 | 0 | 1 | 0 | 0 | 0 | 1 | 0 |

FIG. 31 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 0 | 1 | 0 | 0 | 0 | 1 | 0 |
| 2 | 1 | 0 | 0 | 1 | 1 | 0 | 0 | 1 |
| 3 | 1 | 0 | 1 | 0 | 1 | 0 | 1 | 0 |
| 4 | 1 | 0 | 1 | 0 | 1 | 0 | 1 | 0 |
| 5 | 0 | 0 | 1 | 0 | 0 | 0 | 1 | 0 |
| 6 | 1 | 0 | 0 | 1 | 1 | 0 | 0 | 1 |
| 7 | 1 | 0 | 1 | 0 | 1 | 0 | 1 | 0 |

FIG. 32 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 1 | 0 | 1 | 0 | 1 | 0 | 0 |
| 2 | 1 | 0 | 1 | 0 | 1 | 0 | 1 | 0 |
| 3 | 0 | 1 | 0 | 1 | 0 | 1 | 0 | 1 |
| 4 | 1 | 0 | 1 | 0 | 1 | 0 | 1 | 0 |
| 5 | 0 | 0 | 0 | 1 | 0 | 0 | 0 | 1 |
| 6 | 1 | 0 | 1 | 0 | 1 | 0 | 1 | 0 |
| 7 | 0 | 1 | 0 | 1 | 0 | 1 | 0 | 1 |

FIG. 33 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 1 | 0 | 1 | 0 | 1 | 0 | 1 |
| 2 | 1 | 0 | 0 | 1 | 1 | 0 | 0 | 1 |
| 3 | 1 | 0 | 1 | 0 | 1 | 0 | 1 | 0 |
| 4 | 1 | 0 | 1 | 0 | 1 | 0 | 1 | 0 |
| 5 | 0 | 1 | 0 | 0 | 0 | 1 | 0 | 0 |
| 6 | 1 | 0 | 0 | 1 | 1 | 0 | 0 | 1 |
| 7 | 1 | 0 | 1 | 0 | 1 | 0 | 1 | 0 |

FIG. 34 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 1 | 0 | 1 | 0 | 1 | 0 | 1 |
| 2 | 1 | 0 | 0 | 1 | 1 | 0 | 0 | 1 |
| 3 | 1 | 0 | 1 | 0 | 1 | 0 | 1 | 0 |
| 4 | 1 | 0 | 1 | 0 | 1 | 0 | 1 | 0 |
| 5 | 0 | 1 | 0 | 1 | 0 | 1 | 0 | 0 |
| 6 | 1 | 0 | 0 | 1 | 1 | 0 | 0 | 1 |
| 7 | 1 | 0 | 1 | 0 | 1 | 0 | 1 | 0 |

FIG. 35 pix_cnt

| lin_cnt | 0 | 1 | 2 | 3 | 4 | 5 | 6 | 7 |
|---|---|---|---|---|---|---|---|---|
| 0 | 1 | 0 | 1 | 0 | 1 | 0 | 1 | 0 |
| 1 | 0 | 1 | 0 | 1 | 0 | 1 | 0 | 1 |
| 2 | 1 | 0 | 0 | 1 | 1 | 0 | 0 | 1 |
| 3 | 1 | 0 | 1 | 0 | 1 | 0 | 1 | 0 |
| 4 | 1 | 0 | 1 | 0 | 1 | 0 | 1 | 0 |
| 5 | 0 | 1 | 0 | 1 | 0 | 1 | 0 | 1 |
| 6 | 1 | 0 | 0 | 1 | 1 | 0 | 0 | 1 |
| 7 | 1 | 0 | 1 | 0 | 1 | 0 | 1 | 0 |

FIG. 36 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 0 | 1 | 0 | 1 | 0 | 1 | 0 |
| 2 | 0 | 1 | 1 | 0 | 0 | 1 | 1 | 0 |
| 3 | 0 | 1 | 0 | 1 | 0 | 1 | 0 | 1 |
| 4 | 0 | 1 | 0 | 1 | 0 | 1 | 0 | 1 |
| 5 | 1 | 0 | 1 | 0 | 1 | 0 | 1 | 1 |
| 6 | 0 | 1 | 1 | 0 | 0 | 1 | 1 | 0 |
| 7 | 0 | 1 | 0 | 1 | 0 | 1 | 0 | 1 |

FIG. 37 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 0 | 1 | 0 | 1 | 0 | 1 | 0 |
| 2 | 0 | 1 | 1 | 0 | 0 | 1 | 1 | 0 |
| 3 | 0 | 1 | 0 | 1 | 0 | 1 | 0 | 1 |
| 4 | 0 | 1 | 0 | 1 | 0 | 1 | 0 | 1 |
| 5 | 1 | 0 | 1 | 1 | 1 | 0 | 1 | 1 |
| 6 | 0 | 1 | 1 | 0 | 0 | 1 | 1 | 0 |
| 7 | 0 | 1 | 0 | 1 | 0 | 1 | 0 | 1 |

FIG. 38 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 0 | 1 | 0 | 1 | 0 | 1 | 1 |
| 2 | 0 | 1 | 0 | 1 | 0 | 1 | 0 | 1 |
| 3 | 1 | 0 | 1 | 0 | 1 | 0 | 1 | 0 |
| 4 | 0 | 1 | 0 | 1 | 0 | 1 | 0 | 1 |
| 5 | 1 | 1 | 1 | 0 | 1 | 1 | 1 | 0 |
| 6 | 0 | 1 | 0 | 1 | 0 | 1 | 0 | 1 |
| 7 | 1 | 0 | 1 | 0 | 1 | 0 | 1 | 0 |

FIG. 39 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 1 | 0 | 1 | 1 | 1 | 0 | 1 |
| 2 | 0 | 1 | 1 | 0 | 0 | 1 | 1 | 0 |
| 3 | 0 | 1 | 0 | 1 | 0 | 1 | 0 | 1 |
| 4 | 0 | 1 | 0 | 1 | 0 | 1 | 0 | 1 |
| 5 | 1 | 1 | 0 | 1 | 1 | 1 | 0 | 1 |
| 6 | 0 | 1 | 1 | 0 | 0 | 1 | 1 | 0 |
| 7 | 0 | 1 | 0 | 1 | 0 | 1 | 0 | 1 |

FIG. 40 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 1 | 0 | 1 | 1 | 1 | 0 | 1 |
| 2 | 0 | 1 | 1 | 0 | 0 | 1 | 1 | 0 |
| 3 | 0 | 1 | 0 | 1 | 0 | 1 | 0 | 1 |
| 4 | 0 | 1 | 0 | 1 | 0 | 1 | 0 | 1 |
| 5 | 1 | 1 | 0 | 1 | 1 | 1 | 0 | 1 |
| 6 | 0 | 1 | 1 | 0 | 0 | 1 | 1 | 0 |
| 7 | 0 | 1 | 0 | 1 | 1 | 1 | 0 | 1 |

FIG. 41 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 1 | 0 | 1 | 1 | 1 | 0 | 1 |
| 2 | 0 | 1 | 1 | 0 | 0 | 1 | 1 | 0 |
| 3 | 0 | 1 | 0 | 1 | 1 | 1 | 0 | 1 |
| 4 | 0 | 1 | 0 | 1 | 0 | 1 | 0 | 1 |
| 5 | 1 | 1 | 0 | 1 | 1 | 1 | 0 | 1 |
| 6 | 0 | 1 | 1 | 0 | 0 | 1 | 1 | 0 |
| 7 | 0 | 1 | 0 | 1 | 1 | 1 | 0 | 1 |

FIG. 42 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 1 | 0 | 1 | 1 | 1 | 0 | 1 |
| 2 | 0 | 1 | 1 | 0 | 0 | 1 | 1 | 0 |
| 3 | 0 | 1 | 0 | 1 | 1 | 1 | 0 | 1 |
| 4 | 0 | 1 | 0 | 1 | 0 | 1 | 0 | 1 |
| 5 | 1 | 1 | 0 | 1 | 1 | 1 | 0 | 1 |
| 6 | 0 | 1 | 1 | 0 | 0 | 1 | 1 | 0 |
| 7 | 1 | 1 | 0 | 1 | 1 | 1 | 0 | 1 |

FIG. 43 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 0 | 1 |
| 1 | 1 | 1 | 0 | 1 | 1 | 1 | 0 | 1 |
| 2 | 0 | 1 | 1 | 0 | 0 | 1 | 1 | 0 |
| 3 | 1 | 1 | 0 | 1 | 1 | 1 | 0 | 1 |
| 4 | 0 | 1 | 0 | 1 | 0 | 1 | 0 | 1 |
| 5 | 1 | 1 | 0 | 1 | 1 | 1 | 0 | 1 |
| 6 | 0 | 1 | 1 | 0 | 0 | 1 | 1 | 0 |
| 7 | 1 | 1 | 0 | 1 | 1 | 1 | 0 | 1 |

FIG. 44 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 1 | 1 |
| 1 | 1 | 1 | 0 | 1 | 1 | 1 | 0 | 1 |
| 2 | 0 | 1 | 1 | 0 | 0 | 1 | 1 | 0 |
| 3 | 1 | 1 | 0 | 1 | 1 | 1 | 0 | 1 |
| 4 | 0 | 1 | 0 | 1 | 0 | 1 | 0 | 1 |
| 5 | 1 | 1 | 0 | 1 | 1 | 1 | 0 | 1 |
| 6 | 0 | 1 | 1 | 0 | 0 | 1 | 1 | 0 |
| 7 | 1 | 1 | 0 | 1 | 1 | 1 | 0 | 1 |

FIG. 45 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 1 | 1 |
| 1 | 1 | 1 | 0 | 1 | 1 | 1 | 0 | 1 |
| 2 | 0 | 1 | 1 | 0 | 0 | 1 | 1 | 0 |
| 3 | 1 | 1 | 0 | 1 | 1 | 1 | 0 | 1 |
| 4 | 0 | 1 | 1 | 1 | 0 | 1 | 0 | 1 |
| 5 | 1 | 1 | 0 | 1 | 1 | 1 | 0 | 1 |
| 6 | 0 | 1 | 1 | 0 | 0 | 1 | 1 | 0 |
| 7 | 1 | 1 | 0 | 1 | 1 | 1 | 0 | 1 |

FIG. 46 pix_cnt

| lin_cnt | 0 | 1 | 2 | 3 | 4 | 5 | 6 | 7 |
|---|---|---|---|---|---|---|---|---|
| 0 | 0 | 1 | 0 | 1 | 0 | 1 | 1 | 1 |
| 1 | 1 | 1 | 0 | 1 | 1 | 1 | 0 | 1 |
| 2 | 0 | 1 | 1 | 0 | 0 | 1 | 1 | 0 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 0 | 1 | 1 | 1 | 0 | 1 |
| 6 | 0 | 1 | 1 | 0 | 0 | 1 | 1 | 0 |
| 7 | 1 | 1 | 0 | 1 | 1 | 1 | 0 | 1 |

FIG. 47 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 0 | 1 |
| 2 | 0 | 1 | 1 | 0 | 0 | 1 | 1 | 0 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 0 | 1 | 1 | 1 | 0 | 1 |
| 6 | 0 | 1 | 1 | 0 | 0 | 1 | 1 | 0 |
| 7 | 1 | 1 | 0 | 1 | 1 | 1 | 0 | 1 |

FIG. 48 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 0 | 1 |
| 2 | 0 | 1 | 1 | 0 | 0 | 1 | 1 | 0 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 0 | 1 | 1 | 1 | 0 | 1 |
| 6 | 0 | 1 | 1 | 1 | 0 | 1 | 1 | 0 |
| 7 | 1 | 1 | 0 | 1 | 1 | 1 | 0 | 1 |

FIG. 49 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 0 | 1 |
| 2 | 0 | 1 | 1 | 0 | 0 | 1 | 1 | 1 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 0 | 1 | 1 | 1 | 0 | 1 |
| 6 | 0 | 1 | 1 | 1 | 0 | 1 | 1 | 0 |
| 7 | 1 | 1 | 0 | 1 | 1 | 1 | 0 | 1 |

FIG. 50 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 0 | 1 |
| 2 | 0 | 1 | 1 | 0 | 0 | 1 | 1 | 1 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 0 | 1 | 1 | 1 | 0 | 1 |
| 6 | 0 | 1 | 1 | 1 | 0 | 1 | 1 | 1 |
| 7 | 1 | 1 | 0 | 1 | 1 | 1 | 0 | 1 |

FIG. 51 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 0 | 1 |
| 2 | 0 | 1 | 1 | 1 | 0 | 1 | 1 | 1 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 0 | 1 | 1 | 1 | 0 | 1 |
| 6 | 0 | 1 | 1 | 1 | 0 | 1 | 1 | 1 |
| 7 | 1 | 1 | 0 | 1 | 1 | 1 | 0 | 1 |

FIG. 52 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 0 | 1 |
| 2 | 0 | 1 | 1 | 1 | 0 | 1 | 1 | 1 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 1 | 1 | 1 | 1 | 0 | 1 |
| 6 | 0 | 1 | 1 | 1 | 0 | 1 | 1 | 1 |
| 7 | 1 | 1 | 0 | 1 | 1 | 1 | 0 | 1 |

FIG. 53 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 0 | 1 |
| 2 | 0 | 1 | 1 | 1 | 0 | 1 | 1 | 1 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 1 | 1 | 1 | 1 | 1 | 1 |
| 6 | 0 | 1 | 1 | 1 | 0 | 1 | 1 | 1 |
| 7 | 1 | 1 | 0 | 1 | 1 | 1 | 0 | 1 |

FIG. 54 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 0 | 1 | 1 | 1 | 1 | 1 |
| 2 | 0 | 1 | 1 | 1 | 0 | 1 | 1 | 1 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 1 | 1 | 1 | 1 | 1 | 1 |
| 6 | 0 | 1 | 1 | 1 | 0 | 1 | 1 | 1 |
| 7 | 1 | 1 | 0 | 1 | 1 | 1 | 0 | 1 |

FIG. 55 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 0 | 1 | 1 | 1 | 0 | 1 | 1 | 1 |
| 3 | 1 | 1 | 0 | 1 | 1 | 1 | 0 | 1 |
| 4 | 0 | 1 | 1 | 1 | 0 | 1 | 1 | 1 |
| 5 | 1 | 1 | 1 | 1 | 1 | 1 | 1 | 1 |
| 6 | 0 | 1 | 1 | 1 | 0 | 1 | 1 | 1 |
| 7 | 1 | 1 | 0 | 1 | 1 | 1 | 0 | 1 |

FIG. 56 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 0 | 1 | 1 | 1 | 0 | 1 | 1 | 1 |
| 3 | 1 | 1 | 0 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 1 | 1 |
| 6 | 0 | 1 | 1 | 1 | 0 | 1 | 1 | 1 |
| 7 | 1 | 1 | 0 | 1 | 1 | 1 | 0 | 1 |

FIG. 57 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 0 | 1 | 1 | 1 | 0 | 1 | 1 | 1 |
| 3 | 1 | 1 | 0 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 0 | 1 |
| 6 | 0 | 1 | 1 | 1 | 0 | 1 | 1 | 1 |
| 7 | 1 | 1 | 1 | 1 | 1 | 1 | 1 | 1 |

FIG. 58 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 0 | 1 | 1 | 1 | 0 | 1 | 1 | 1 |
| 3 | 1 | 1 | 0 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 1 | 1 |
| 6 | 0 | 1 | 1 | 1 | 0 | 1 | 1 | 1 |
| 7 | 1 | 1 | 1 | 1 | 1 | 1 | 1 | 1 |

FIG. 59 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 0 | 1 | 1 | 1 | 0 | 1 | 1 | 1 |
| 3 | 1 | 1 | 1 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 1 | 1 |
| 6 | 0 | 1 | 1 | 1 | 0 | 1 | 1 | 1 |
| 7 | 1 | 1 | 1 | 1 | 1 | 1 | 1 | 1 |

FIG. 60 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 1 | 1 | 0 | 1 | 1 | 0 | 1 | 1 |
| 3 | 1 | 1 | 1 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 1 | 1 |
| 6 | 1 | 1 | 0 | 1 | 1 | 1 | 1 | 1 |
| 7 | 1 | 1 | 1 | 1 | 1 | 1 | 1 | 1 |

FIG. 61 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 1 | 1 | 1 | 0 | 1 | 1 | 1 | 1 |
| 3 | 1 | 1 | 1 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 1 | 1 |
| 6 | 1 | 1 | 1 | 0 | 1 | 1 | 1 | 1 |
| 7 | 1 | 1 | 1 | 1 | 1 | 1 | 1 | 1 |

FIG. 62 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 1 | 1 | 1 | 0 | 1 | 1 | 1 | 1 |
| 3 | 1 | 1 | 1 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 1 | 1 |
| 6 | 1 | 1 | 1 | 1 | 1 | 1 | 1 | 1 |
| 7 | 1 | 1 | 1 | 1 | 1 | 1 | 1 | 1 |

FIG. 63 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 0 | 1 | 1 | 1 |
| 1 | 1 | 1 | 1 | 1 | 1 | 1 | 1 | 1 |
| 2 | 1 | 1 | 1 | 1 | 1 | 1 | 1 | 1 |
| 3 | 1 | 1 | 1 | 1 | 1 | 1 | 1 | 1 |
| 4 | 0 | 1 | 1 | 1 | 0 | 1 | 1 | 1 |
| 5 | 1 | 1 | 1 | 1 | 1 | 1 | 1 | 1 |
| 6 | 1 | 1 | 1 | 1 | 1 | 1 | 1 | 1 |
| 7 | 1 | 1 | 1 | 1 | 1 | 1 | 1 | 1 |

FIG. 64 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 1 | 1 | 1 | 1 |
| 1 | 1 | 1 | 1 | 1 | 1 | 1 | 1 | 1 |
| 2 | 1 | 1 | 1 | 1 | 1 | 0 | 1 | 1 |
| 3 | 1 | 1 | 1 | 1 | 1 | 1 | 1 | 1 |
| 4 | 1 | 1 | 1 | 1 | 1 | 1 | 1 | 1 |
| 5 | 1 | 1 | 1 | 1 | 1 | 1 | 1 | 1 |
| 6 | 1 | 1 | 1 | 0 | 1 | 1 | 1 | 1 |
| 7 | 1 | 1 | 1 | 1 | 1 | 1 | 1 | 1 |

FIG. 65 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 1 | 1 | 1 | 1 |
| 1 | 1 | 1 | 1 | 1 | 1 | 1 | 1 | 1 |
| 2 | 1 | 1 | 1 | 1 | 1 | 1 | 1 | 1 |
| 3 | 1 | 1 | 1 | 1 | 1 | 1 | 1 | 1 |
| 4 | 1 | 1 | 1 | 1 | 0 | 1 | 1 | 1 |
| 5 | 1 | 1 | 1 | 1 | 1 | 1 | 1 | 1 |
| 6 | 1 | 1 | 1 | 1 | 1 | 1 | 1 | 1 |
| 7 | 1 | 1 | 1 | 1 | 1 | 1 | 1 | 1 |

FIG. 66 pix_cnt

| lin_cnt | 0 | 1 | 2 | 3 | 4 | 5 | 6 | 7 |
|---|---|---|---|---|---|---|---|---|
| 0 | 0 | 1 | 1 | 1 | 1 | 1 | 1 | 1 |
| 1 | 1 | 1 | 1 | 1 | 1 | 1 | 1 | 1 |
| 2 | 1 | 1 | 1 | 1 | 1 | 1 | 1 | 1 |
| 3 | 1 | 1 | 1 | 1 | 1 | 1 | 1 | 1 |
| 4 | 1 | 1 | 1 | 1 | 1 | 1 | 1 | 1 |
| 5 | 1 | 1 | 1 | 1 | 1 | 1 | 1 | 1 |
| 6 | 1 | 1 | 1 | 1 | 1 | 1 | 1 | 1 |
| 7 | 1 | 1 | 1 | 1 | 1 | 1 | 1 | 1 |

FIG. 67

DISPERSION-BASED TECHNIQUE FOR PERFORMING SPACIAL DITHERING FOR A DIGITAL DISPLAY SYSTEM

FIELD OF THE INVENTION

This invention relates to the field of performing spacial dithering for a digital display system. More particularly, the invention relates to a dispersion-based technique for performing spacial dithering for a digital display system.

BACKGROUND OF THE INVENTION

For displaying an image on a digital display, pixels are individually modulated to be either in an 'on' condition or in an 'off' condition. For example, the 'on' condition can represent white and the 'off' condition can represent black. To provide more information and realism in the image, it is generally desired to provide intermediate intensities or greyscale levels. Pulse width modulation (PWM) is a well known technique for achieving intermediate greyscale levels. According to PWM, the pixels are rapidly toggled a varying portion of the time between 'on' and 'off'. The larger a percentage of time the pixel is 'on'. the closer to white the pixel is displayed. A viewer's eye integrates the intensity of a toggled pixel over time to perceive grey rather than merely black or white. Thus, the intensity level for the pixel depends upon the relative durations of the 'on' state and the 'off' state.

To display a complete image, each pixel of the display is modulated according to data representative of the image to be displayed. The spacial resolution of the display image is related to the total number of pixels included in the display; as the number of pixels is increased, the spacial resolution is also increased. U.S. patent application Ser. No. 08/893,872, entitled, "A Dispersion-Based Technique for Modulating Pixels of a Digital Display," filed on the same day as this application and having the same inventor, the contents of which are hereby incorporated by reference, discloses a technique for pulse-width modulating pixels of a display according to an image to be displayed.

It is well understood that pulse-width modulation can also be applied to color systems for forming varying intensities and shades of color. Color display panels differ from black and white display panels in that color display panels generally include a group of three sub-pixels for each pixel, each sub-pixel corresponding to one of the three primary colors, red, green and blue. Typically, a filter of the appropriate primary color is placed over each of the sub-pixels. To display an image, each of the sub-pixels is individually modulated to provide a selected intensity for each of the three primary colors. A viewer's eye perceives a color that is an integration of the three sub-pixel intensities to visualize the selected color for the pixel.

The number of color levels that can be represented in the display by individual pixels (color resolution) is generally limited by the number of bits the display system is capable of accepting and displaying for each sub-pixel. For example, if eight bits are utilized to represent each sub-pixel in a display memory, up to 256 levels of the corresponding primary color can be represented in the display memory for individual sub-pixels. If, however, the display system is capable of accepting only six bits of display data for each sub-pixel, then only sixty-four levels of the corresponding primary color can be displayed by individual sub-pixels on the display panel.

When an image to be displayed includes an area of a color that is not one of the available colors that can be displayed by a pixel, a next closest color can be selected for each pixel in the area. Because the number of available colors is limited, however, the display image will generally not have an appearance that is as realistic or pleasing as is desired. For example, when an image having an area of gradual color change is displayed, the color change will be displayed step-wise, rather than gradually, resulting in an undesired appearance of contouring at the boundaries between steps.

Therefore, it is generally preferred that a digital display have a high color resolution as this generally results in a more pleasing and realistic display image. For example, higher color resolution reduces the tendency for contouring to appear in the display image. As the color resolution is increased, however, so does the number of bits required to represent each sub-pixel. Thus, as the color resolution is increased, the display will generally have a higher cost.

Dithering is a technique for increasing the number of apparent display colors relative to the number of bits actually utilized to represent the intensity for each sub-pixel in the display. Dithering relies upon the viewer's eye integrating colors to visualize a combined color. For example, if it is desired to display an area having a color that is not one of the available colors for display by a pixel, rather than selecting a next closest color for the entire area, pixels of different colors are interspersed with each other in the area The eye integrates the different colors to visualize an intermediate color that is closer to the desired color than any of the colors available for display by individual pixels.

Dithering involves selecting which pixels of the area are to display each of the different colors. According to conventional dithering techniques, the pixels of different colors are selected according to a regular, repeating pattern in the area. A drawback to this technique is that the viewer's eye can often perceive this pattern as artifacts in the image. For example, false motion artifacts, such as lines, can appear to move in the display image. Thus, the expected benefits of dithering, such as reduced contouring in areas of gradual color change and generally more pleasing and realistic display image, can be negated by artifacts introduced as a result of the dithering technique.

Therefore, what is needed is a technique for dithering a digital display system with image data that does not introduce artifacts into the display image.

SUMMARY OF THE INVENTION

The invention is a dispersion-based technique for performing spacial dithering for a digital display system. A display panel is portioned into eight-by-eight arrays of pixels. Each pixel includes three sub-pixels, each sub-pixel corresponding to a primary color. Display data for each of the three color channels is applied to a corresponding one of three dither blocks. The dither blocks accept a predetermined number of bits for representing a color level for each sub-pixel of the corresponding primary color according to an image to be displayed. The display system can accept a number of bits for representing each sub-pixel that is the same or less than the predetermined number of bits. If the display system can accept a same number of bits, no dither operation is required and the bits are passed to the display system unchanged. If the display can accept only fewer bits than the predetermined number, bits must be discarded. The discarded bits, however, are utilized to modify the remaining bits according to a dither operation before the individual sub-pixels of the display panel are modulated according to remaining bits.

The dither operation for each of the three color channels is performed by respective dither blocks. A memory is accessible by each of the dither blocks. The memory stores sixty-four tables, each table including an entry for each pixel within an eight-by-eight array of pixels. The entry for a pixel determines whether or not the color level for the corresponding sub-pixel is to be decremented by one. A first of the sixty-four tables does not result in decrementing any color levels. Each successive table decrements the color level for one more sub-pixel than the previous table. For example, the last of the sixty-four tables results in decrementing the color level for sixty-three out of the sixty-four sub-pixels in an eight-by-eight array. Entries in the tables are dispersed so as to avoid decrementing color levels in a pattern that would otherwise tend to result in image artifacts. This is accomplished by generally avoiding vertical, horizontal or diagonal lines of pixels, and by avoiding checkerboard patterns of pixels for which the color level is decremented.

Each dither block includes a circuit that separates the bits to be discarded from the bits that are to be passed to the display system. The values of discarded bits select among the stored tables, whereas, the values of bits that are retained are selectively decremented according to entries in the selected table. As an example of the dithering operation, assume eight bits of data represent color levels of individual sub-pixels in an image to be displayed. Assume also that a particular display system can only accept six of the eight bits. The two least significant bits are used to appropriately select from among four of the sixty-four tables. A first of the four tables is also the first of the sixty-four tables; it does not cause any bits to be decremented. Each of the other three tables selectively decrement the color level of pixels to provide color levels for the eight-by-eight array that are between those that can be specified by the retained six bits. Therefore, a second of the four tables causes sixteen out of the sixty four levels to be decremented by one; a third of the four tables causes thirty-two out of the sixty-four levels to be decremented by one; and a fourth of the four tables causes forty-eight out of the sixty-four levels to be decremented by one. The remaining six bits are passed to the display, except that those levels corresponding to pixel positions that are to be decremented by one are so decremented before being passed to the display.

By utilizing the stored tables for selecting appropriate bits to be decremented, patterns for decrementing color levels can be avoided by dispersing within each eight-by-eight array the sub-pixels for which the color level is decremented. As a result, artifacts induced by the dithering process are reduced in comparison to prior dithering techniques.

BRIEF DESCRIPTION OF THE DRAWINGS

FIGS. 4–67 illustrate data tables 0–63, respectively, which represent values stored in the dither tables in FIGS. 1A–B.

DETAILED DESCRIPTION OF A PREFERRED EMBODIMENT

Figure 1A:
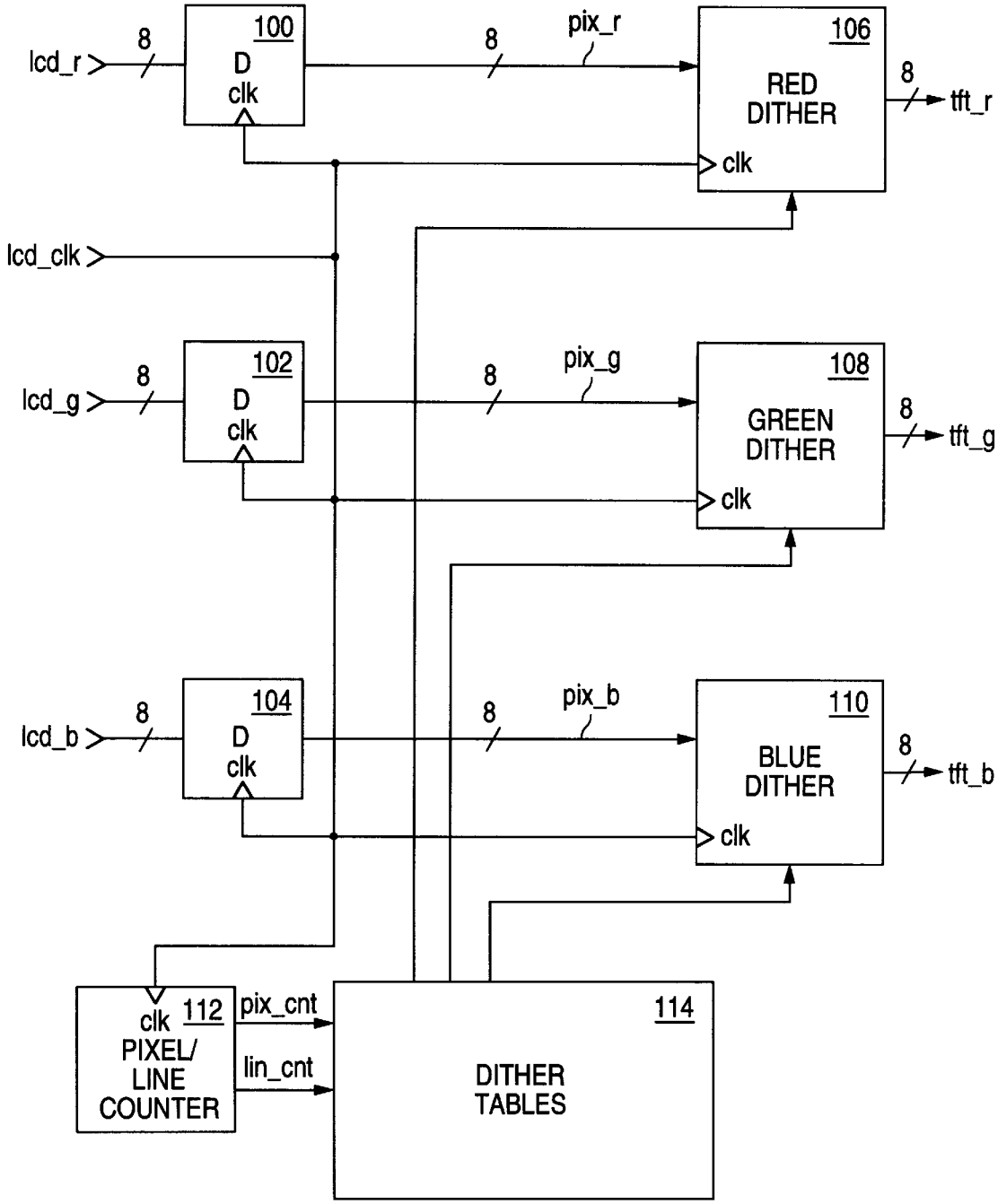
FIGS. 1A–B illustrate a block schematic diagram of a circuit according to the present invention for performing spacial dithering on display data
Figure 1B:
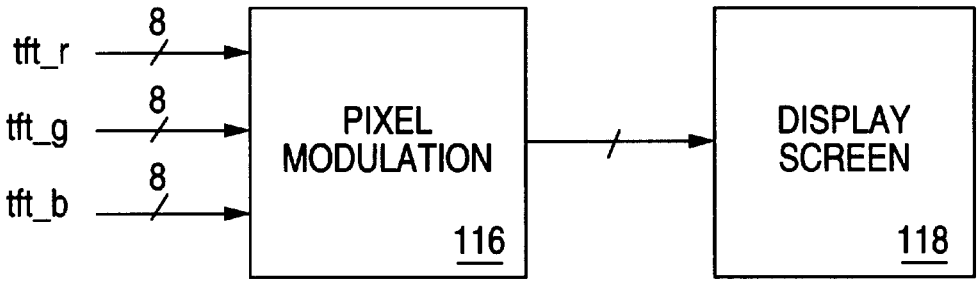

FIG. 1A–B illustrate a block schematic diagram of a circuit according to the present invention for performing spacial dithering on display data. A display data stream, lcd_r for a red channel of a display system is coupled to an input of a first delay 100. A display data stream, lcd_g, for a green channel of the display system is coupled to an input of a second delay 102. A display data stream, lcd_b, for the blue channel of the display system is coupled to an input of a third delay 104. Each of the display data streams, lcd_r, lcd_g, and lcd_b, is preferably a series of eight-bit digital values for coupling to a conventional digital display system, though it will be apparent that the present invention can be practiced using display data streams of other widths. The display data streams, lcd_r, lcd_g, and lcd_b, are representative of an image to be displayed in each of a series of display frames.

The output, pix_r, of the delay 100 is coupled to an input of a Red Dither block 106. The output, pix_g, of the delay 102 is coupled to an input of a Green Dither block 108. The output, pix_b, of the delay 104 is coupled to an input of a Blue Dither block 110. The delays, 100, 102 and 104 are each clocked according to the clock signal, led_clk, to ensure that the data streams, pix_r, pix_g, and pix_b, appearing at the outputs of each of the delays 100, 102, and 104, are appropriately synchronized for processing by the dither blocks 106, 108 and 110. The delays 100, 102 and 104 can be conventional shift registers, flip-flops or other delay circuits.

An output, tft_r, of the Red Dither block 106 is a data stream for the red channel of a digital display system dithered according to the present invention. An output, tft_g, of the Green Dither block 108 is a data stream for the green channel of the digital display system dithered according to the present invention. An output, tft_b, of the Blue Dither block 110 is a data stream for the blue channel of the digital display system dithered according to the present invention. Thus, the present invention intercepts each display data stream, lcd_r, lcd_g, and lcd_b, for performing spacial dithering before coupling dithered data streams, tft_r, tft_g, and tft_b, to a digital display system. The digital display system includes a modulation block 116 for modulating individual pixels of a digital display panel 118 according to these data streams. Preferably, pixels are modulated by the modulation block 116 according to the teachings of the above-identified co-pending application entitled, "A Dispersion-Based Technique for Modulating Pixels of a Digital Display." The dithered data streams, tft_r, tft_g, and tft_b, are each a same number of bits wide, preferably, eight bits vide, though only a selected number of the bits are valid and coupled to the modulation block 116. The number of bits of each of the data streams, tft_r, tft_g, and tft_b, that are valid and coupled to the display system is selectively adjustable according to the requirements of a particular display system.

Figure 2:
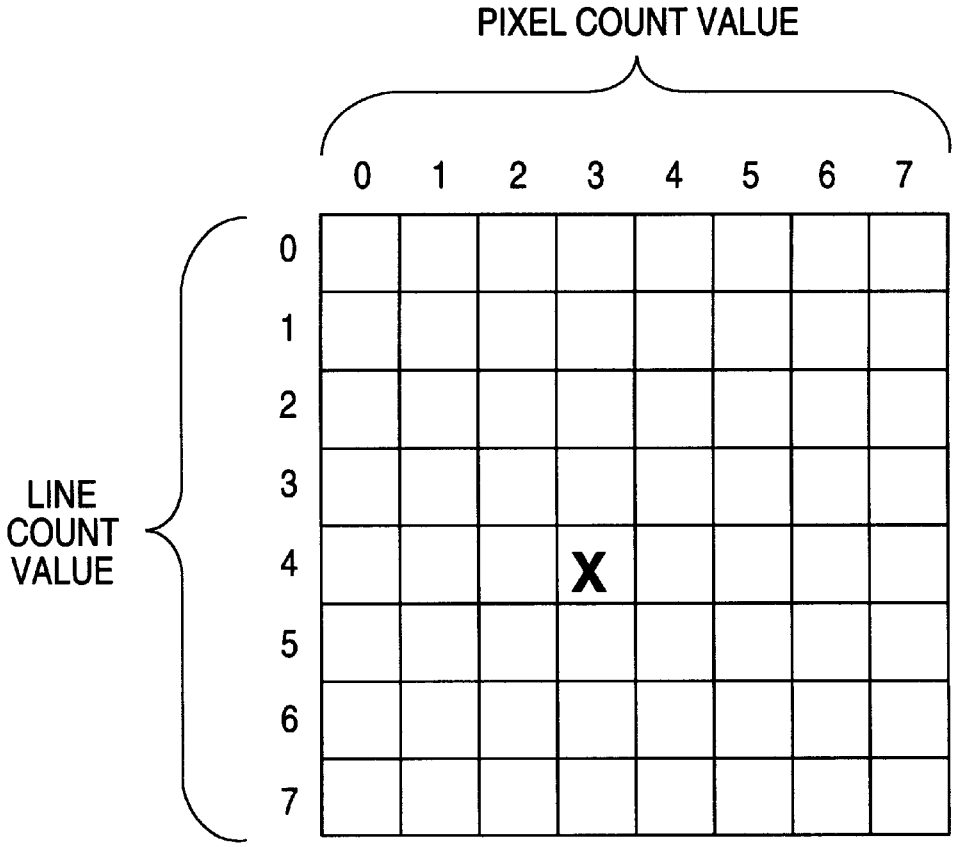
FIG. 2 illustrates an eight-by-eight array of sixty-four pixels of a display panel.

The dithering technique according to the present invention operates on groups (arrays) of pixels. Therefore, the display panel 118 is divided into portions, each portion preferably includes an eight-by-eight array of pixels. FIG. 2 illustrates one such eight-by-eight array 200 of sixty-four pixels of a complete display panel 118. For simplicity, the following description will focus on a single eight-by-eight array 200. It will be understood, however, that the principles described herein are applicable to each eight-by-eight array 200 of an entire display panel 118. For example, a display panel having 640 columns and 480 rows of pixels will have eighty columns and sixty rows of eight-by-eight arrays 200. Each eight-by-eight array 200 of the complete display panel 118 will display image data appropriate for its respective position in the complete display panel 118. Though eight-by-eight arrays are preferred, it will be apparent that arrays of other sizes can be utilized. For example, the array can include four, six, eight, ten, twelve or more rows and four, six, eight, ten, twelve or more columns. It will be apparent that the array can include a number of rows equal to the number of columns or a number of rows that is different than the number of columns.

Referring to FIGS. 1A and 1B, a pixel/line counter 112 provides a pixel count value, pix_cnt, and a line count value, lin_cnt, to a memory device 114. The pixel count value, pix_cnt, is incremented for each cycle of the clock signal, lcd_clk, and is preferably three bits wide. The line count value, lin_cnt, is incremented each time a complete horizontal line (row) of pixels has been updated in the display panel 118 and is also three bits wide. As illustrated in FIG. 2, the line count value, lin_cnt, specifies a particular row in the eight-by-eight array 200, while the pixel count value, pix_cnt, specifies a particular column in the eight-by-eight array 200. Together, the pixel count value, pix_cnt, and the line count value, lin_cnt, specify a particular pixel in the eight-by-eight array 200. For example, the pixel having a pixel count value, pix_cnt, of three and a line count value, lin_cnt, of four can be uniquely identified as: (3,4). The pixel (3,4) is identified in FIG. 2 with an "X".

Each of the dither blocks 106, 108 and 110, can be of like construction as each performs like functions upon the respective data stream, pix_r, pix_g, and pix_b, coupled to each dither block 106, 108 and 110. The dither blocks 106, 108 and 110 each perform a dithering function for one of the three primary color channels. The memory device 114 stores a plurality of dither tables for use by each of the dither blocks 106. 108 and 110, as will be explained in more detail herein. For simplicity, the following discussion will focus on a single dither block 106, 108 or 110; it will be understood, however, that the principles described herein are applicable to each of the other dither blocks.

Figure 3A:
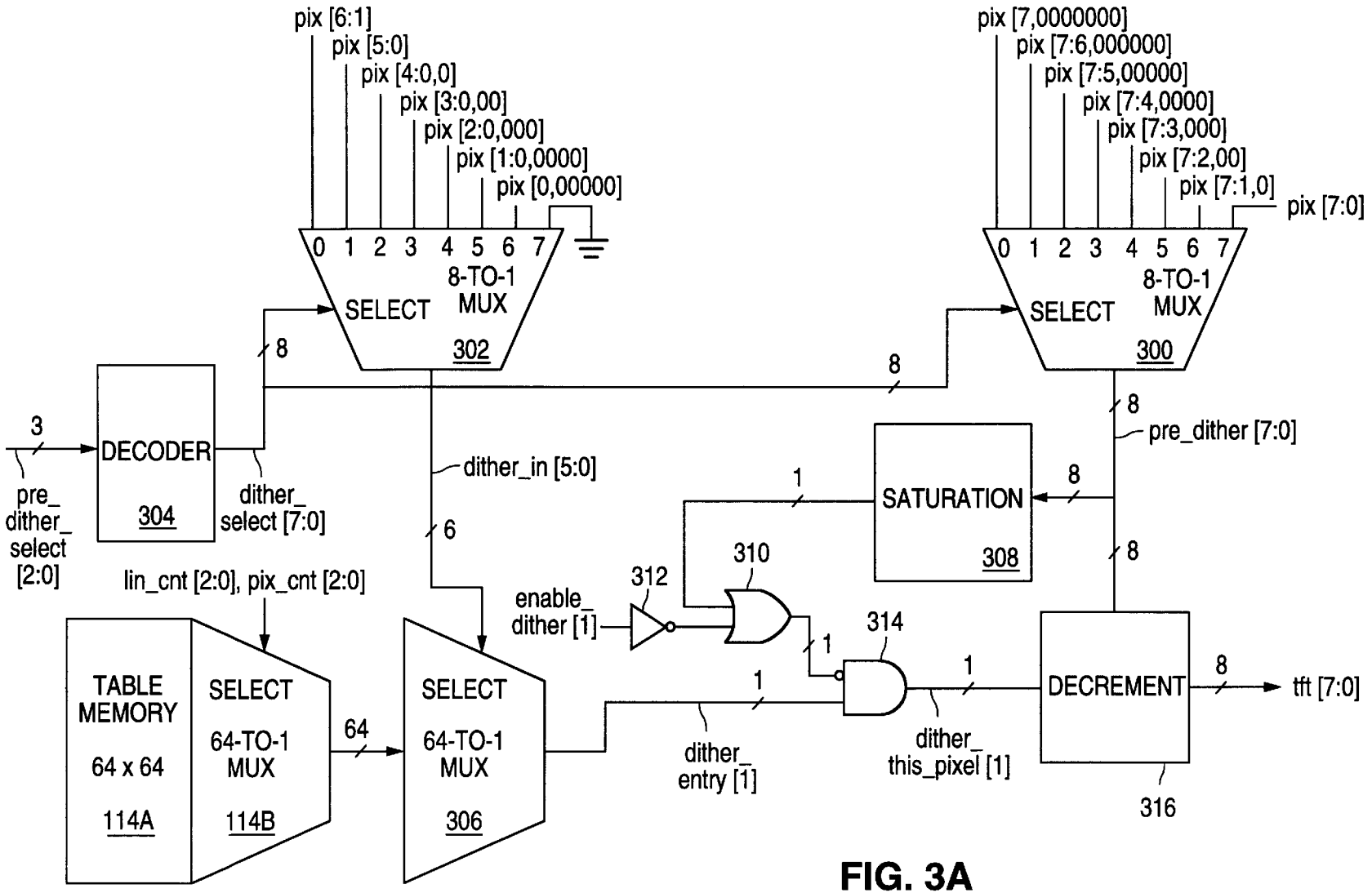
FIGS. 3A–B illustrate alternate block schematic diagrams of a single dither block.

FIG. 3A illustrates a block schematic diagram of a single dither block 106, 108 or 110. The data stream, pix_r, pix_g, or pix_b, illustrated in FIG. 1, is referred to simply as "pix" in FIG. 3A. Because the data stream, pix, is a stream of preferably eight-bit values, all eight bits can be represented as pix[7:0] (where the "7" represents the most significant bit, the "0" represents the least significant bit and the ":" represents the intervening bits). Selected bits of the stream of values, pix[7:0], are coupled to inputs 0–7 of an 8-to-1 multiplexer 300 as follows: the one most significant bit and seven appended zeros, pix[7,0000000], are coupled to the "0" input of the multiplexer 300; the two most significant bits and six appended zeros, pix[7:6,000000], are coupled to the "1" input of the multiplexer 300; the three most significant bits and five appended zeros, pix[7:5,00000], are coupled to the "2" input of the multiplexer 300; the four most significant bits and four appended zeros, pix[7:4,0000], are coupled to the "3" input of the multiplexer 300; the five most significant bits and three appended zeros, pix[7:3,000], are coupled to the "4" input of the multiplexer 300; the six most significant bits and two appended zeros, pix[7:2,00], are coupled to the "5" input of the multiplexer 300; the seven most significant bits and one appended zero, pix[7:1,0], are coupled to the "6" input of the multiplexer 300; and all eight bits of pix[7:0] are coupled to the "7" input of the multiplexer 300. The output of the multiplexer 300 is a stream of eight-bit values, pre_dither[7:0].

Selected bits of the data stream, pix[7:0], are also coupled inputs 0–7 of an 8-to-1 multiplexer 302 as follows: the seventh through the second least significant bits, pix[6:1], are coupled to the "0" input of the multiplexer 302; the six least significant bits, pix[5:0] are coupled to the "1" input of the multiplexer 302; the five least significant bits and one appended zero, pix[4:0,0] are coupled to the "2" input of the multiplexer 302; the four least significant bits and two appended zeros, pix[3:0,00], are coupled to the "3" input of the multiplexer 302; the three least significant bits and three appended zeros, pix[2:0,000], are coupled to the "4" input of the multiplexer 302; the two least significant bits and four appended zeros, pix[1:0,0000], are coupled to the "5" input of the multiplexer 302; the one least significant bit and five appended zeros are coupled to the "6" input of the multiplexer 302; and each bit coupled to the "7" input is a logical zero. The output of the multiplexer 302 is a stream of six-bit values, dither_in[5:0].

A decoder 304 is coupled to receive a three-bit value, pre_dither_select[2:0]. The output of the decoder 304 is an eight-bit value, dither_select[7:0], wherein an appropriate one of the eight bits is a logical one and the remaining bits are each a logical zero. The value, dither_select[7:0], is coupled to a select input of the multiplexer 300 and to a select input of the multiplexer 302 for selecting an appropriate one of the inputs "0–7" of the multiplexers 300 and 302 to appear at their respective outputs. The values of pre_dither_select[3:0] and dither_select[7:0] are representative of the number of bits the display panel is capable of displaying and, thus, determine a number of bits of the signal, tft, that will be valid for representing the color of individual sub-pixels on the display panel. The signal, tft[7:0], illustrated in FIG. 3A corresponds to the data stream tft_r, tft_g, or tft_b, illustrated in FIG. 1.

The multiplexers 300 and 302 select bits of the stream of values, pix[7:0], in a complementary manner. Because the multiplexers 300 and 302 receive the same dither_select value[7:0], corresponding inputs will be concurrently selected to appear at the outputs of the multiplexers 300 and 302. For example, when dither select[7:0] is conditioned to select the "7" input of each of the multiplexers 300 and 302, as would be the case when the display panel is capable of displaying all eight bits of pix[7:0] for each sub-pixel, the output, pre_dither[7:0], of the multiplexer 300 is a stream of values that will include all eight bits of pix[7:0], whereas, the output, dither_in[5:0], of the multiplexer 302 is a stream of values that will include only zeros. In such case, a dithering operation is not required and the values, pix[7:0], pass to the display panel unchanged.

For a display panel that does not display a sub-pixel color level corresponding to each value of pix[7:0], bits must be discarded. The discarded bits, however, are used for appropriately modifying (dithering) the remaining bits before they are passed to the display panel, as explained herein. For example, if the display panel is capable of accepting seven bits for each sub-pixel, then pre_dither_select[7:0] will be conditioned to select the "6" input of each of the multiplexers 300 and 302. In such case, the output of the multiplexer 300 will include the seven most significant bits of the value, pix[7:0], and one appended zero (as a place holder for the invalid bit), while the output of the multiplexer 302 will include the least significant bit and five appended zeros (as place holders). Alternately, if the display panel is capable of accepting six bits for each sub-pixel, then pre_dither select [7:0] will be conditioned to select the "5" input of each of the multiplexers 300 and 302. In such case, the output of the multiplexer 300 will include the six most significant bits of the value, pix[7:0], and two appended zeros (as place holders), while the output of the multiplexer 302 will include the two least significant bits of the value, pix[7:0], and four appended zeros (as place holders).

This pattern continues for each value of pre_dither_select[7:0] except when the "0" input is selected. In such case, the output of the multiplexer 300 will include the single most significant bit of the value pix[7:0] and seven appended zeros, whereas, the output of the multiplexer 302 will include the seventh through second least significant bits of the value. Thus, the least significant bit is not utilized for dithering the remaining bits. In such case, the loss of this bit will affect the display quality, however, it is expected that color display panels capable of accepting only a single bit for each sub-pixel will be uncommon. In an alternate embodiment, however, the display is divided into arrays of 128 pixels, rather than the preferred arrays of sixty-four pixels. In this alternate embodiment, the least significant bit is utilized for dithering.

As an example of the operation of the multiplexers 300, 302 and the decoder 304, assume that at a point in time, the value of the signal, pix[7:0], is 01010111. Therefore, referring to the inputs of the multiplexer 300, pix[7,0000000] is 10000000; pix[7:6,000000] is 10000000; pix[7:5,00000] is 10100000; pix[7:4,0000] is 10100000; pix[7:3,000] is 10101000; pix[7:2,00] is 10101000; pix[7:1,0] is 10101010; and pix[7:0] is 10101011. Referring to the inputs of the multiplexer 302, pix[6:1] is 010101; pix[5:0] is 101011; pix[4:0,0] is 010110; pix[3:0,00] is 101100; pix[2:0,000] is 011000; pix[1:0,0000] is 110000; and pix[0,00000] is 100000.

Assume that each sub-pixel of the display panel can represent one of sixty-four different levels of the corresponding primary color. Therefore, the display system can accept six bits of color data for each sub-pixel and two bits must be discarded. Accordingly, the value of pre_dither_select[2:0], is selected to be 101. This causes pix[7:2,00] to appear at the output of the multiplexer 300 and pix[1:0,0000] to appear at the output of the multiplexer 302. Thus, pre_dither[7:0] is 10101000 and dither_in[5:0] is 101011. Note that pre_dither[7:0] retains the six most significant bits of the value pix[7:0] and that dither_in[5:0] retains the two least significant bits of the value pix[7:0]. Because the least significant two bits are not directly displayed, they are utilized for dithering the remaining six bits, as explained herein.

Recall that the display panel 118 is preferably divided into eight-by-eight arrays 200 of sixty-four pixels. Dithering involves decrementing by one the color level for selected sub-pixels within the eight-by-eight arrays 200, such that an average color level for sub-pixels in the eight-by-eight array 200 is representative of bits that the display system does not accept Accordingly, as a result of dithering, the color levels for pixels within the eight-by-eight array 200 are representative of all eight bits of the stream of values, pix[7:0], even though some of the bits cannot be displayed directly. The Tables 0–63 in FIGS. 4–67, respectively, are representative of values stored in the Dither Tables 114 illustrated in FIG. 1 and are utilized to determine which color levels for pixels of an eight-by-eight array 200 are to be decremented based upon the value of the bits not directly displayed. Each of Tables 0–63 has sixty-four entries, each entry corresponding to a pixel in the eight-by-eight array 200.

The Tables 0–63 are stored in a memory device 114A, preferably, a 64-by-64 random access memory (RAM). The memory device is coupled to a multiplexer 114B. The pixel count value, pix_cnt[2:0], and the line count value, lin_cnt[2:0], are coupled to a select input of the multiplexer 114B to specify a particular entry in each of the Tables 0–63 to appear at the output of the multiplexer 114B corresponding to the position of the current pixel in an eight-by-eight array 200. Each entry in each of Tables 0–63 corresponds to a unique combination of the pix count value, pix_cnt[2:0], and the line count value, lin_cnt[2:0]. For example, referring to Table 1, when pix_cnt[2:0] is 000 and lin_cnt[2:0] is 000, the location specified is (0,0) and the table entry is 1; for all other values of pix_cnt[2:0] and lin_cnt[2:0], the corresponding table entry is 0.

Because there are sixty-four tables, there are sixty-four table entries for each combination of the pix count value, pix_cnt[2:0], and the line count value, lin_cnt[2:0]. Thus, for each pixel count value, pix_cnt[2:0], and line count value, lin_cnt[2:0], each of these sixty-four entries from Tables 0–63 are coupled to the inputs of the multiplexer 306 as follows: the table entry specified by pix_cnt[2:0] and lin_cnt[2:0] in Table 0 is coupled to the "0" input of the multiplexer 306; the table entry specified by pix_cnt[2:0] and lin_cnt[2:0] in Table 1 is coupled to the "1" input of the multiplexer 306; the table entry specified by pix cnt[2:0] and lin_cnt[2:0] in Table 2 is coupled to the "2" input of the multiplexer 306; and so forth, such that an entry from each of the remaining Tables 0–63 specified by pix_cnt[2:0] and lin_cnt[2:0] is coupled to an input of the multiplexer 306 having a same number as the corresponding table.

Because the multiplexer 306 has sixty-four inputs, six bits are required to select a particular input to appear at the output of the multiplexer 306. The select input of the multiplexer 306 is coupled to receive the value, dither in[5:0], from the multiplexer 302. Thus, the output, dither_in[5:0], of the multiplexer 300 is used to specify which of the Tables 0–63 is to be used to for determining whether or not to decrement a color level for a sub-pixel. Note that each of the sixty-four Tables 0–63 has a number of entries of value 1 that corresponds to the number of the table. For example, Table 0 has no 1's, Table 14 has fourteen 1's and Table 31 has thirty-one 1's.

The output of the multiplexer 306 is a single bit, dither_entry, which specifies whether or not the color level (output from the multiplexer 300) for the current sub-pixel should be decremented. If the value of the color level for the current sub-pixel is all zeros, this indicates a boundary condition (i.e. color saturation). Thus, if the color level for the sub-pixel is decremented, the color level will erroneously change from all zeros to all ones. To prevent this from occurring, the output of the multiplexer 300, pre_dither[7:0], is coupled to a saturation block 308. The output of the saturation block 308 is a logical one when the value of pre_dither[7:0] is all zeros. This signal is coupled to a first input of an OR gate 310.

A control input, enable_dither[1], is provided to allow an external circuit to selectively enable/disable dithering. This control input can be used, for example, for preventing a border for the display screen from being dithered. The control input, enable_dither[1], is coupled to an input of an inverter 312. The output of the inverter 312 is coupled to a second input of the OR gate 310. An output of the OR gate 310 is coupled to an inverting input of an AND gate 314. The output of the multiplexer 306, dither_entry[1], is coupled to a non-inverting input of the AND gate 314. An output of the AND gate 314, dither_this_pixel[1], is coupled to a decrement block 316. When the output, dither_this_pixel[1], of the AND gate 314 is logical one, the value of the valid bits of pre_dither[7:0] is decremented by one before being passed to the display panel. When dither_this_pixel[1] is a logical zero, the value pre_dither[7:0] is passed to the display panel unchanged.

As an example of the operation of the present invention, assume a display system can display six bits of image data for each sub-pixel. In such case, pre_dither_select[2:0] is conditioned to select the "5" inputs of the multiplexers 300 and 302 to appear at the respective outputs. Therefore, the value of pre_dither[7:0] is the most significant six bits of pix[7:0] with two appended zeros and the value of dither_in[5:0] is the least significant two bits with four appended zeros. The two least significant bits are used to selectively modify the most significant six bits to represent colors intermediate to those that can be represented directly by the most significant bits. This is accomplished by decrementing the color level of selected sub-pixels within an eight-by-eight array 200. Suppose that for a particular sub-pixel, the least significant bits of pix[7:0] are 11. In such case, the most significant bits adequately represent the desired color and, thus, no decrementing is needed. In this case, dither_in[5:0] will be 000000. Thus. Table 0 will be selected. Referring to Table 0, for each sub-pixel in the eight-by-eight array, dither_entry[1] is 0. Accordingly, the color level for the sub-pixel will not be decremented.

Suppose, however, that the least significant bits are 10. In such case, it is desired to selectively decrement by one the color level for the sub-pixel to achieve an appropriate intermediate color level. In this case, dither_in[5:0] will be 010000. Thus, Table 16 will be selected. Table 16 includes sixteen ones out of the sixty-four entries. Therefore, on average, for a particular sub-pixel, there is a 25 percent chance that the color level will be decremented. The color level for the sub-pixel will be decremented if the position of the sub-pixel in the eight-by-eight array corresponds to an entry of one in the table.

Suppose, however, that the least significant bits are 01. In such case, it is desired to selectively decrement by one the color level for the sub-pixel to achieve an appropriate intermediate color level. In this case, dither in[5:0] will be 100000. Thus. Table 32 will be selected. Table 32 includes thirty-two ones out of the sixty-four entries. Therefore, on average, for a particular sub-pixel, there is a 50 percent chance that the color level will be decremented. The color level for the sub-pixel will be decremented if the position of the sub-pixel in the eight-by-eight array corresponds to an entry of one in the table.

Suppose that the least significant bits are 00. In such case, it is desired to selectively decrement by one the color level for the sub-pixel to achieve an appropriate intermediate color level. In this case, dither_in[5:0] will be 110000. Thus, Table 48 will be selected. Table 48 includes forty-eight ones out of the sixty-four entries. Therefore, on average, for a particular sub-pixel, there is a 75 percent chance that the color level will be decremented. The color level for the sub-pixel will be decremented if the position of the sub-pixel in the eight-by-eight array corresponds to an entry of one in the table.

Figure 3B:
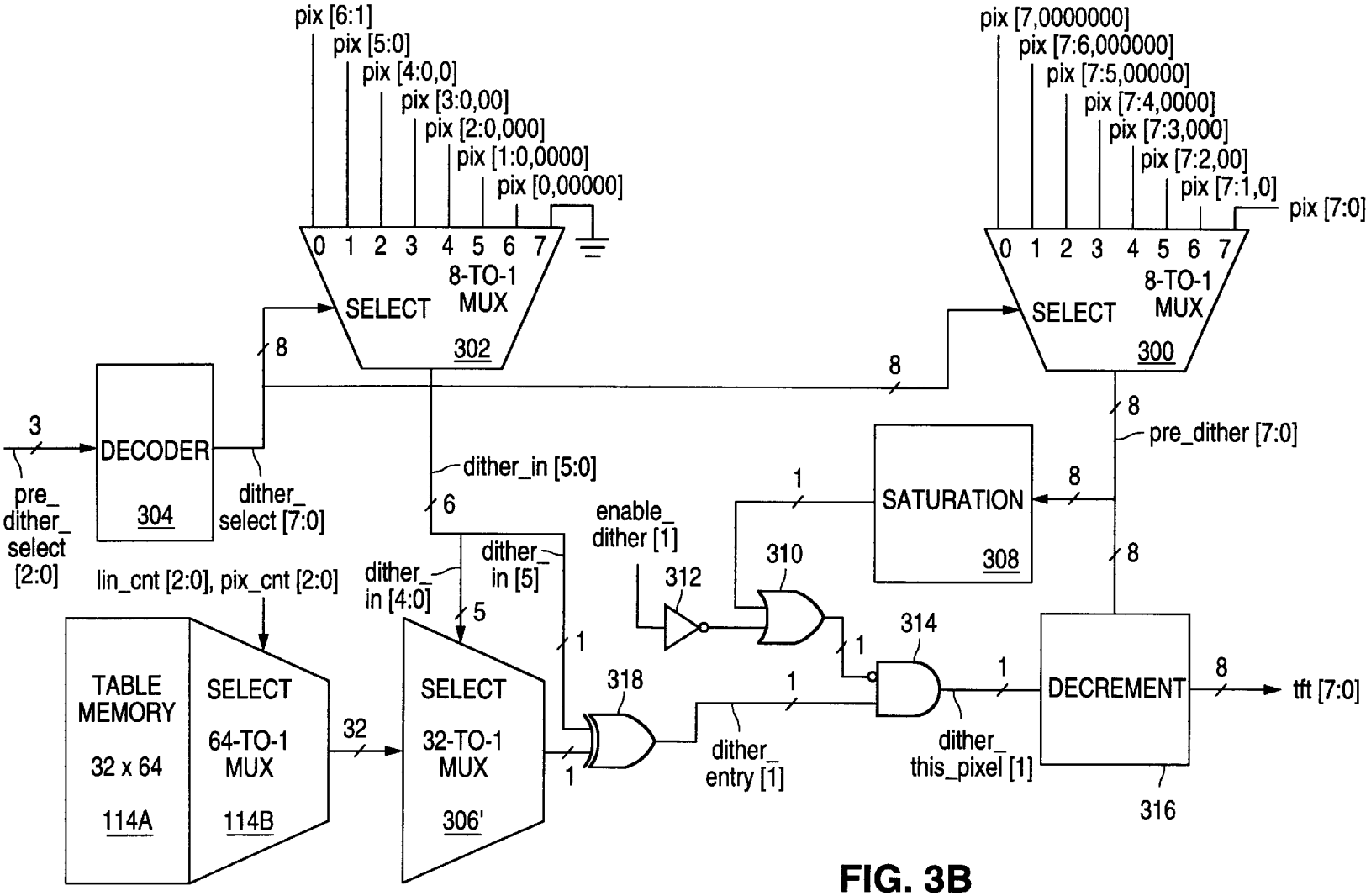

In an alternate embodiment illustrated in FIG. 3B, rather than storing each of sixty-four different tables, to save memory space and associated costs, only thirty-two tables are stored. For the remaining thirty-two tables, each entry in an appropriate one of the stored tables is inverted. Accordingly, a 32-by-64 table memory 114A is coupled to a 64-to-1 multiplexer 114B'. The table memory 114A' stores Tables 0–31, while Tables 32–63 are not stored. The line count value, lin-cnt[2:0], and pixel count value, pix_cnt [2:0], are coupled to a select input of the multiplexer 114B'. Thus, for each pixel count value, pix_cnt[2:0], and line count value, lin_cnt[2:0], a corresponding entry in each of the thirty-two Tables 0–31 appears at the output of the multiplexer 114B'.

The output of the multiplexer 114B' is a thirty-two bit value, each bit coupled to a corresponding input of a 32-to-1 multiplexer 306'. The five least significant bits, dither_in [4:0], of the output of the multiplexer 302 are coupled to the select input of the multiplexer 306' and the most significant bit dither_in[5] is coupled to a first input of an exclusive-OR gate 318. The output of the multiplexer 306' is coupled to a second input of the exclusive-OR gate 318. The output of the exclusive-OR gate 318 forms the value dither entry [1].

According to the embodiment illustrated in FIG. 3B, when the most significant bit, dither in[5], is a zero, the appropriate entry from the Tables 0–31 is selected to appear at the output of the multiplexer 306 by the least significant bits, dither in[4:0]'. When dither_in[5] is a one, however, the output of the multiplexer 306' is inverted by the exclusive-OR gate 318. Thus, the appropriate entry for the Tables 32–63 is formed by inverting entries from the Tables 0–31. For example, to form the Table 32, each entry in the Table 31 is inverted; to form the Table 33, each entry in the Table 30 is inverted; and so forth. Note, however, that Table 31 has thirty-one ones. If Table 31 is inverted, the resulting Table 32 will have 33 ones. It is desired, however, that Table 32 have 32 ones. Therefore, according to this alternate embodiment, a small amount of error is introduced. The embodiment illustrated in FIG. 3B is preferred, however, due to the savings in required memory space.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention. Specifically, it will be apparent to one of ordinary skill in the art that the device of the present invention could be implemented in several different ways and the apparatus disclosed above is only illustrative of the preferred embodiment of the invention and is in no way a limitation. In particular, it will be apparent that the numbers of bits included in various digital values disclosed herein can be altered.

What is claimed is:

1. A method of performing spacial dithering upon a stream of data values representative of an image to be displayed on a display panel for forming a stream of dithered values, wherein each dithered value includes a number of valid bits that is less than a number of bits included in each data value, the method comprising steps of:

a. removing a number of least significant bits from each of the stream of data values for forming a stream of truncated values, wherein the stream of truncated values includes a number of valid bits; and b. selectively decrementing each of the stream of truncated values according to a corresponding entry in a selected table for forming the stream of dithered values wherein the selected table is selected from a group of stored tables according to the bits removed from each truncated value.

2. The method according to claim 1 further comprising a step of modulating pixels of the display panel according to the stream of dithered values.

3. The method according to claim 1 wherein the selected table includes an entry corresponding to each of an array of pixels.

4. The method according to claim 3 wherein the array of pixels includes eight rows of pixels arranged in eight columns.

5. The method according to claim 3 wherein entries indicative of decrementing the corresponding truncated value are arranged other than in vertical, horizontal or diagonal lines of corresponding pixels.

6. A method of performing spacial dithering upon a stream of data values representative of an image to be displayed on a display panel for forming a stream of dithered values, wherein each dithered value includes a number of valid bits that is less than a number of bits included in each data value, the method comprising steps of:

a. removing a number of least significant bits from each of the stream of data values for forming a stream of truncated values, wherein the stream of truncated values includes a number of valid bits;

b. selecting a table from a group of tables wherein the table is selected according to the bits removed from each truncated value and wherein the table includes an entry corresponding to each of an array of pixels, each entry indicative of whether or not a corresponding truncated value is to be decremented and wherein a ratio of entries indicative of decrementing the corresponding truncated value to entries not indicative of decrementing the corresponding truncated value is related to a value of the removed bits; and c. selectively decrementing each of the stream of truncated values according to the corresponding entry in the selected table for forming the stream of dithered values.

7. The method according to claim 6 wherein the entries indicative of decrementing the corresponding truncated value are arranged other than in vertical, horizontal or diagonal lines of corresponding pixels.

8. The method according to claim 6 further comprising a step of modulating pixels of the display panel according to the stream of dithered values.

9. The method according to claim 6 wherein the array of pixels includes sixty-four pixels.

10. The method according to claim 9 wherein the array of pixels includes eight rows of pixels arranged in eight columns.

11. An apparatus for selectively performing spacial dithering upon a stream of data values representative of an image to be displayed on a display panel for forming a stream of dithered values wherein each dithered value includes a number of valid bits that is equal to or less than a number of bits included in each data value, the apparatus comprising:

a. a circuit for selectively removing a number of least significant bits from each of the stream of data values for forming a stream of truncated values wherein the stream of truncated values includes a number of valid bits; and b. a circuit for selectively decrementing each of the stream of truncated values according to a corresponding entry in a selected table for forming the stream of dithered values wherein the selected table is selected from a group of tables according to the bits removed from each truncated value.

12. The apparatus according to claim 11 further comprising a circuit for modulating pixels of the display panel according to the stream of dithered values.

13. The apparatus according to claim 11 wherein the table includes an entry corresponding to each of an array of pixels, each entry indicative of whether or not a corresponding truncated value is to be decremented.

14. The apparatus according to claim 13 wherein the entries indicative of decrementing the corresponding truncated value are arranged other than in vertical, horizontal or diagonal lines of corresponding pixels.

15. The apparatus according to claim 13 wherein a ratio of entries indicative of decrementing the corresponding truncated value to entries not indicative of decrementing the corresponding truncated value is related to a value of the removed bits.

16. The apparatus according to claim 13 wherein the array of pixels includes sixty-four pixels.

17. The apparatus according to claim 16 wherein the array of pixels includes eight rows of pixels arranged in eight columns.

18. An apparatus for selectively dithering a data value representative of an intensity for a pixel in a display panel for forming a dithered value, wherein the dithered value includes a number of valid bits that is equal to or less than a number of bits included in the data value, the apparatus comprising:

a. a decrement circuit having a data input, a control input and an output, wherein the data input of the decrement circuit is coupled to receive a selected number of most significant bits of the data value, the decrement circuit for selectively decrementing a value of the selected most significant bits of the data value according to a level of the control input of the decrement circuit and wherein the output of the decrement circuit forms the dithered value;

b. a multiplexer having a plurality of data inputs, a control input and an output, wherein the output of the multiplexer is coupled to the control input of the decrement circuit and wherein the control input of the multiplexer is coupled to receive a value representative of a value of a selected number of least significant bits of the data value; and c. plurality of stored tables, each table including a plurality of entries, each entry corresponding to a position in an array of pixels and each entry indicative of whether or not a value of the selected most significant bits of the data value is to be decremented by the decrement circuit, wherein each table entry corresponding to the position of the pixel in the array is coupled to a corresponding one of the data inputs of the multiplexer.

19. The apparatus according to claim 18 further comprising a circuit for modulating pixels of the display panel according to the stream of dithered values.

20. The apparatus according to claim 18 wherein the entries indicative of decrementing the corresponding truncated value are arranged other than in vertical, horizontal or diagonal lines of corresponding pixels.

21. The apparatus according to claim 18 wherein for each table, a ratio of entries indicative of decrementing the value of the selected most significant bits to entries not indicative of decrementing the value of the selected most significant bits is related to the selected number of least significant bits.

22. The apparatus according to claim 18 wherein the pixel is a sub-pixel corresponding to a primary color.

23. The apparatus according to claim 18 wherein the array of pixels includes sixty-four pixels.

24. The apparatus according to claim 23 wherein the array of pixels includes eight rows of pixels arranged in eight columns.

* * * * *